United States Patent [19]

Kleine

[11] 3,960,223

[45] June 1, 1976

[54] DRILL FOR ROCK

[75] Inventor: Werner Kleine, Bremen, Germany

[73] Assignee: Gebrueder Heller, Uphusen, Germany

[22] Filed: Mar. 12, 1975

[21] Appl. No.: 557,779

[30] Foreign Application Priority Data

Mar. 26, 1974 Germany ..... 2414354

[52] U.S. Cl. ..... 175/385; 175/390; 175/398; 175/410; 175/415

[51] Int. Cl.[2] ..... E21C 13/08

[58] Field of Search ..... 175/385, 389, 390, 407, 175/395, 410, 415, 398, 400

[56] References Cited

UNITED STATES PATENTS

| | | | |
|---|---|---|---|
| 1,169,369 | 1/1916 | Wakfer | 175/389 |
| 1,746,423 | 2/1930 | Hartman | 175/385 |
| 2,578,593 | 12/1951 | Phipps | 175/385 |
| 2,759,705 | 8/1956 | Bjorkman | 175/389 |
| 2,879,037 | 3/1959 | Wolfram | 175/390 |
| 3,118,511 | 1/1964 | Kay | 175/410 X |
| 3,372,763 | 3/1968 | Fischer | 175/394 |

*Primary Examiner*—Ernest R. Purser
*Assistant Examiner*—Richard E. Favreau
*Attorney, Agent, or Firm*—Martin A. Farber

[57] ABSTRACT

A drill for rock comprising a boring head arranged on one end of a drill shank and having radially projecting wings, an axial centering projection which projects in a boring direction in front of the wings, said wings and said projection constituting carriers of eccentrically arranged cutter bodies and a centering cutter body, respectively. Breaker surfaces are formed on the wing surfaces between the cutter bodies, respectively, pointing to the centering point of the centering cutter body. Each surface of the boring head located between the wings has at least one jacket line which extends longitudinally to the axis of the boring head and directly joins to a jacket line of the outer surface of the centering projection and is inclined relative thereto at an obtuse angle.

20 Claims, 10 Drawing Figures

DRILL FOR ROCK

The invention relates to a drill for rock and the like with a boring head which is arranged on the end of a drill shank and having at least two radial projecting wings and with an axial centering projection which projects in the direction of boring in front of the wings, said wings and said centering projection serve as carriers of cutter bodies eccentrically arranged on the radial outer ends of the wings, and, respectively, on said centering projection, said centering cutter body on said centering projection forms a centering point and projects in the direction of boring and radially from the centering projection, and from which centering cutter body the radial inner ends of the eccentrically arranged cutter bodies are arranged at such radial distances that the parts of the wing surfaces which point to the centering point and which are not occupied by the eccentrically arranged cutter bodies, form breaker surfaces which break annular surfaces of the rock to be bored during drilling, which annular surfaces are not worked by the cutter bodies, whereby at least the wings of a boring head body jutting out of the drill shank are formed of steel.

By German Pat. No. 967,491 and German OS No. 2,129,913, rock drills of this type are known with which the boring head body is constructed as an annular body securable on the drill shank or, respectively, is formed itself on the drill shank.

This type of rock drill has the advantage that the cutter bodies are made of, as a rule, a fragile hard material, as hard metal or the like, which hard material is suitable for a long service life of the cutters, and the boring head body as well as the centering projection, the latter which is formed from the drill shank or from the boring head body, are made of a resistant, yet elastic material, as steel, suitable for a long service life of the boring head. Thereby, however, the disadvantage also occurs that the boring head body for the acceptance of the required forces during the drilling and breaking, and particularly during the percussive boring, must be executed radially jutting out with respect to the drill shank, whereby with the known boring heads of this type, according to new expectations of the inventor confirmed by tests, the boring capacity is impaired.

Accordingly, it is an object of the present invention to produce a drill for rock of this type which has a substantially larger boring capacity compared with the known rock drills.

This object is solved with a drill for rock of the introductory named type, in accordance with the present invention, in the manner that each channel type surface of the boring head body, which surface is located between the wings, has at least one jacket line which extends longitudinally to the axis of the boring head and directly joins to a jacket line of the outer surface of the centering projection and with respect to this is inclined at an obtuse angle.

According to the above mentioned expectations of the inventor, it appears with the known rock drill of this type that the performance is impaired in the manner, that the boring head body forms an annular shaped shoulder surface extending radially about the centering projection which connects the breaking surfaces formed by the wings with each other. This shoulder surface lies on the borings during drilling, whereby a deeper penetration of the cutters into the rock is prevented. Particularly during the percussive boring, the borings located between the annular shaped shoulder surface and the boring ground bring about the dampening of the impact.

In the manner that according to the invention every surface of the boring head body which is located between the wings has at least one jacket line which extends longitudinally to the axis of the boring head and directly joins to a jacket line of the outer surface of the centering projection, it is achieved that the breaker surfaces formed by the wings are intercepted by channel type removal surfaces for the borings respectively between the wings, the bottom of which removal surfaces being formed by the named jacket line located between the wings. The borings which engage on the breaker surfaces during the drilling and/or during the percussive boring, can now be removed longitudinally to these removal surfaces from the breaker surfaces of the wings, so that the boring head can penetrate in the bore so deeply that the breaker surfaces of the wings lie on the annular surface of the rock to be bored which is unworked by the cutter bodies, or jolt during the percussive boring, and consequently cause the breaking.

Tests with the rock drill produced in accordance with the present invention have shown that with the latter, a surprising increase in the boring capacity is attained. In order to promote the removal of the borings from the breaker surfaces of the wings, there can be provided, and it is another object of the invention to so provide, in a preferred embodiment form of the invention, that the breaker surfaces of the wings are convexly curved.

A particularly large boring capacity results if the boring head body has more than two, preferably four wings mounted with cutter bodies.

In accordance with a further advantageous embodiment form it is provided, also in accordance with another object of the invention, that the wings run helically shaped about the boring head axis. In this manner it is achieved that the borings, which are removed from the breaker surfaces of the wings longitudinally to the removal surfaces, between the wings, during the rotation of the drill, are fed away from the boring location by the helical shaped form of the wings, so that in this manner the desired effect in accordance with the invention can still be further improved. This effect can still be further improved in the manner that at least one helically shaped wing forms the foward end of a helix, which is constructed on the drill shank for carrying off the borings. Corresponding to the above named known boring bodies, the boring head can also form the centering projection and preferably can be formed on the drill shank. The boring head body can yet also be formed as an annular body fixable on the drill shank which head body forms the wings, and between the latter respectively forms at least the one jacket line which joins directly to a jacket line of the outer surface of the centering projection, which centering projection is formed from the end of the boring shank.

With the above and other objects in view, the present invention will be readily understood with reference to the following detailed description in connection with the accompanying drawings, of which:

Figure 1:
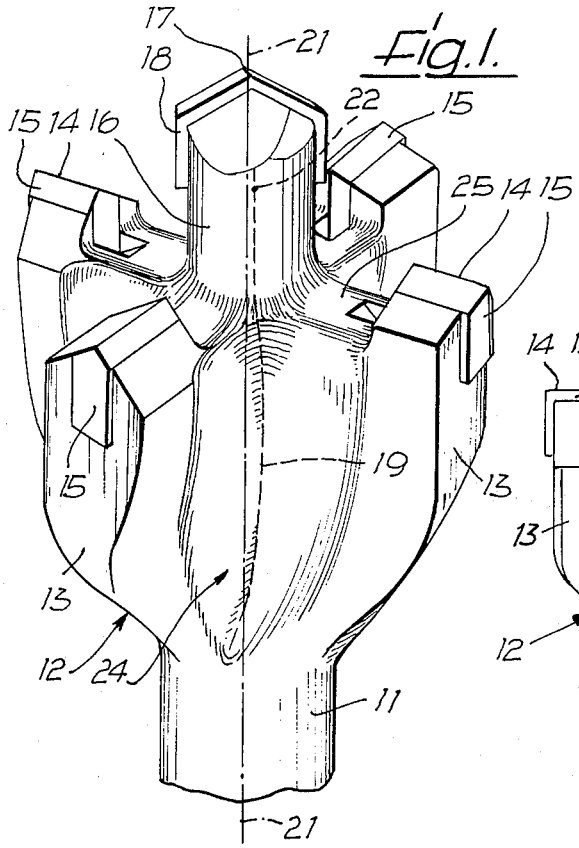
FIG. 1 is a perspective view of the bore head of the present invention according to a first embodiment example thereof.
Figure 3:
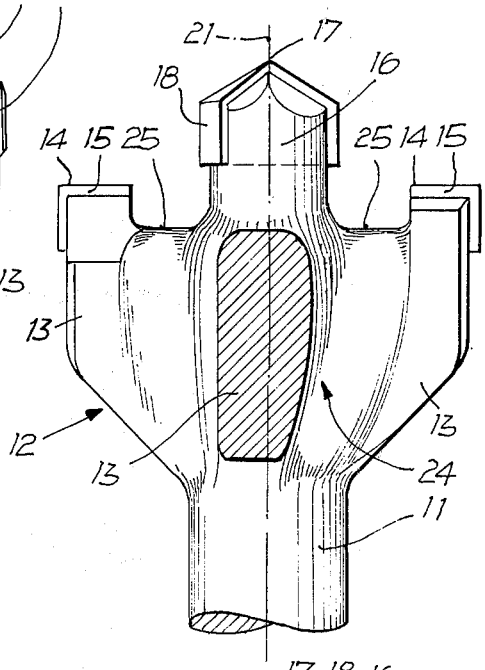
FIG. 3 is a section along the lines III — III of FIG. 2.
Figure 2:
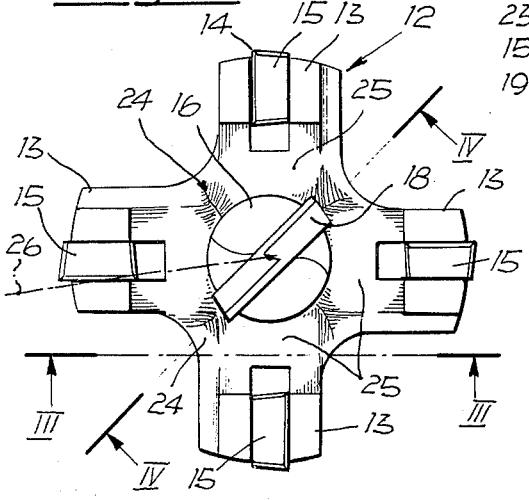
FIG. 2 is a front view of the bore head of FIG. 1.
Figure 4:
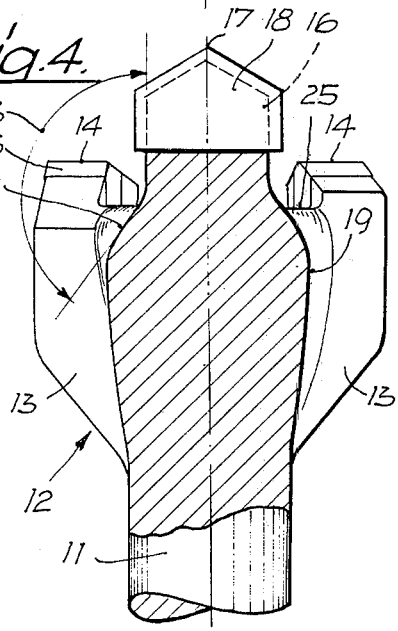
FIG. 4 is a section along the lines IV — IV of FIG. 2.

Referring now to the drawings, and more particularly to the embodiment example illustrated in FIGS. 1 – 4, a borer or drill for rock or the like comprises a boring head body 12 formed on the one end of a drill shank 11, which boring head body has four radially projecting wings 13 which constitute a carrier of cutter bodies 15, the latter forming cutting edges in the following called cutters 14, respectively, eccentrically arranged and substantially radially aligned. The boring head body 12 has on its front end, a centering projection 16 for a centering point 17, the centering projection 16 axially extending in the boring direction in front of the wings 13, the centering point 17 being formed on a centering cutter body 18, the latter projecting in the boring direction and radially from the centering projection 16. The radial inner ends of the eccentrically arranged cutter bodies 15 are arranged at such a radial distance from the axis 21 of the boring head body 12 that the parts of the wing surfaces pointing to the centering point 17, which parts are unoccupied by the eccentrically arranged cutter bodies 15, form breaker surfaces 25. The breaker surfaces 25 break annular surfaces of the to be bored rock during drilling or percussive boring, which annular surfaces are not worked by the cutter bodies 15 and 18.

The transition surface of the boring head body 12, which surface extends between two adjacent wings 13, has a jacket line 19 which extends longitudinally to the axis 21 of the boring head body 12 and directly joins to a jacket line 22 (which jacket line 22 is parallel to the axis 21 of the boring head body 12) of the cylindrical outer surface of the centering projection 16 and with respect to this its joining end is inclined at an obtuse angle 23 of substantially more than 120°. This jacket line 19 bounding the side surfaces which point to each other of two adjacent wings forms thereby the bottom of a channel type removal surface 24, which removal surface is limited by the side surfaces of the wings 13, which side surfaces pass over into each other, and by which the borings can be removed from the breaker surfaces 25. For better removal, the breaker surfaces 25 are convexly curved. In order to advance the removal of the borings from the breaker surfaces 25 and generally from the place of boring, the wings 13 run helically shaped about the axis 21 of the boring head body 12, as particularly evident from FIGS. 1 and 3. The eccentrically arranged cutters 14 form each an acute angle with an imaginary radial plane 26 cutting them, in such a direction, that an inclination occurs by which the borings are advanced radially outwardly during the boring (note FIG. 2).

The embodiment example of a drill illustrated in FIGS. 1 – 4, especially advantageously permits introduction for the percussive boring. In this connection the boring head operates similarly to the known boring heads of this type, only with the difference that the borings which occur between the boring ground and the breaker surfaces 25 during the hitting of the boring head on the boring ground, are pushed away in the intermediate space between the wings 13 by the turning of the drill with the illustrated boring head and there they are removed longitudinally to the channel shaped removal surface 24. In this manner it is avoided that the borings form an interfering layer under the breaker surfaces 25 which obstructs the cutting or penetration of the cutters 14 in the boring ground and dampens the impacts of the drill. By the helically shaped formation of the wings 13, it is achieved thereby that these wings operate as a screw, which promotes the guiding away of the borings longitudinally to the boring head axis 21 away from the place of boring. By the inclination of the cutters 14 with respect to the radial plane 26, it is furthermore contributed that the borings produced by the eccentrically arranged cutters 14 come as little as possible on the breaker surfaces 25.

Figure 5:
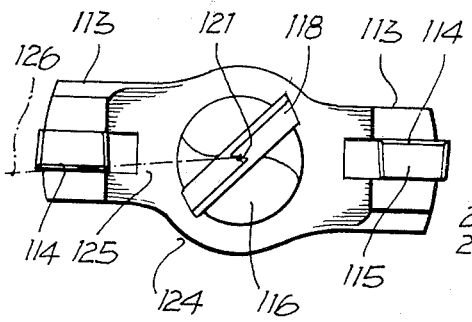
FIG. 5 is a front view of a bore head in accordance with a second embodiment example of the invention.
Figure 6:
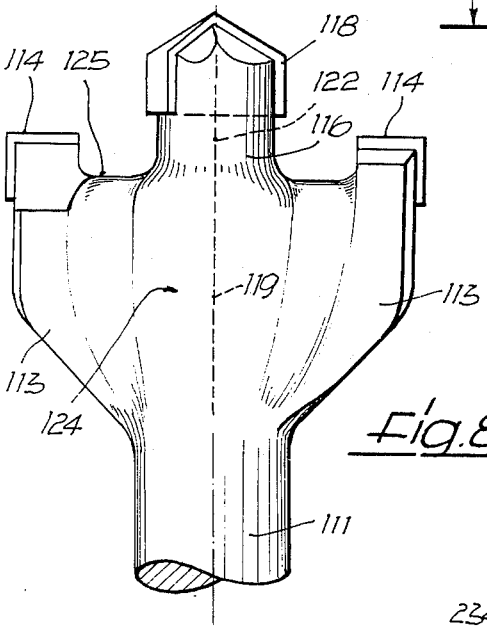
FIG. 6 is a side view of the bore head of FIG. 5.

In the embodiment example illustrated in FIGS. 5 and 6, the like parts corresponding to those of FIGS. 1 – 4 are designated with reference numerals which are increased by 100 with respect to those of the latter figures, so that in this manner reference may be made to the description of the first embodiment example.

The embodiment example illustrated in FIGS. 5 and 6 differs from the first embodiment example in the manner that here only two wings 113 are provided. With this embodiment example the jacket line 122 of the centering projection 116, which jacket line is parallel to the axis 121 of the boring head, proceeds in the range between the two wings 113 directly into the jacket line 119 of the surface of the drill shank 111, the latter surface being between the wings 113, so that also here it is guaranteed that the borings can be removed from the breaker surfaces 125 between the wings 113 longitudinally along the removal surfaces 124. Also with this embodiment example the eccentrically arranged cutters 114 are inclined with respect to radial planes 126 cutting them, as described in connection with the first embodiment.

Figure 7:
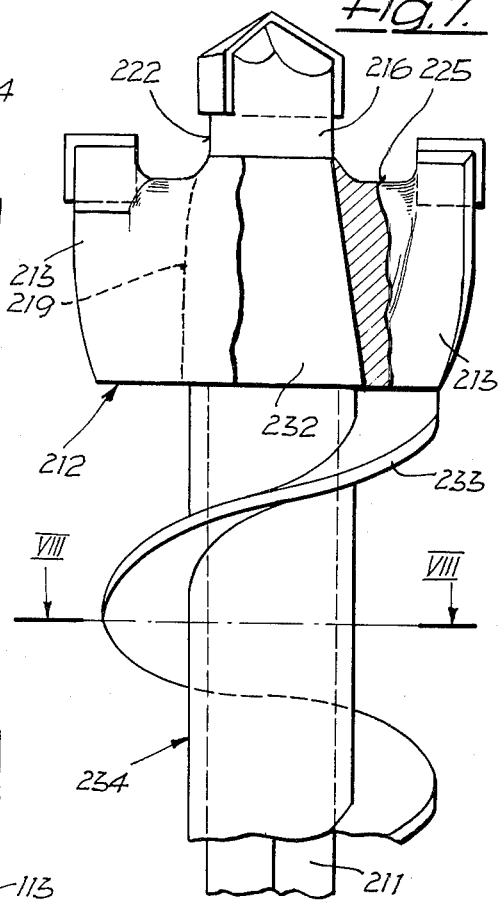
FIG. 7 is a side view of a third embodiment example of the invention.
Figure 8:
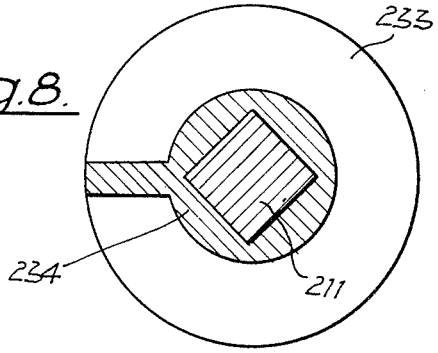
FIG. 8 is a section along the lines VIII — VIII of FIG. 7.

In the embodiment example illustrated in FIGS. 7 and 8, all like parts corresponding to those of the first embodiment example are designated with reference numerals which are increased by 200 with respect to those of the first embodiment, so that in this manner reference may be made to the description of the first embodiment.

The third embodiment differs from the preceeding embodiment example in the manner that here only the centering projection 216 is formed on the drill shank 211 and that the boring head body 212 is constructed as an annular body which sits on a thickened portion 232 of the drill shank 211, the thickened portion tapering in the shape of a truncated pyramid toward the centering projection 216 in its rear part and in the shape of a truncated cone, in its continuously connecting front part. In back of the thickened portion 232 the drill shank 211 is formed as a four edged part, for example, as shown in FIG. 8. Further, the construction of the boring head body 212 corresponds in its outer contour substantially to the boring head body 12 of the first embodiment example so that here a particular description is unnecessary. In every case the boring head body 212 forms a jacket line 219 between the wings, which jacket line directly joins to at least one jacket line 222 of the cylindrical outer surface of the centering projection 216 at an angle larger than 120°, so that the borings can be easily conducted away from the breaker surfaces 225 of the wings 213. Also with the third embodiment the wings are helically shaped, as has been described in connection with the first embodiment example. In distinction to the previous embodiment examples, the one of the two helically shaped wings 213 forms the front end of a helix 233, which helix is formed on a helical body 234 made of synthetic material, which helical body is provided with a four edged opening in which the four edged part of the shank 211 exactly fits in tightly. By means of the four edged cross-section of the shank 211 and the rear part of the thickened portion 232, it is achieved that the one helically shaped wing 213 always fits exactly on the helix 233 and in this manner forms the front end of this helix.

Figure 9:
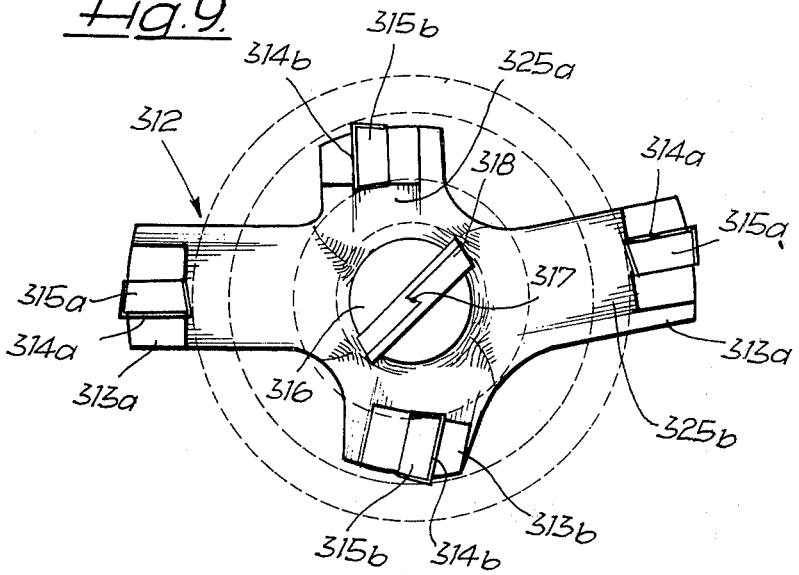
FIG. 9 is a front view of a bore head in accordance with a fourth embodiment example of the invention.
Figure 10:
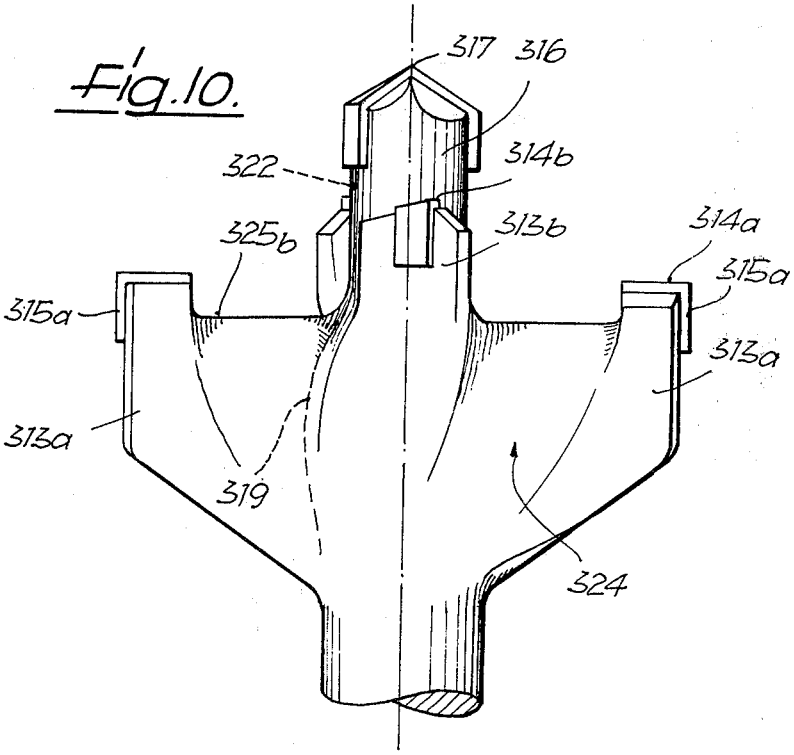
FIG. 10 is a side view of the bore head of FIG. 9.

In the embodiment example illustrated in FIGS. 9 and 10, the like parts of the fourth embodiment corresponding to those of the first embodiment example are designated with reference characters increased by 300 with respect to those of the first embodiment example, so that in this manner reference may be made to the description of the first embodiment example.

The fourth embodiment example differs from the first embodiment example in the manner that two different wing pairs 313*a* and 313*b* are provided. The wings 313*a* of the first pair, which wings are approximately diametrically opposite to each other, have a substantially larger radial dimension than that of the wings 313*b* of the second pair, so that the eccentrically arranged cutter bodies 315*a* are located at a substantially larger distance from the boring head axis 321 than the cutter bodies 315*b* of the wings 313*b*. The difference of the radial distances of the cutter bodies 315*a* and 315*b* from the boring head axis 321 is so large that during drilling or percussive boring with the fourth embodiment example of a boring head, not only is there left over an annular surface of the rock to be bored which is unworked by the cutter bodies 315*b* and 318 between the inner cutter bodies 315*b* and the centering cutter body 318, but also between the inner eccentrically arranged cutter bodies 315*b* and the outer eccentrically arranged cutter bodies 315*a*, a further annular surface of the rock to be bored remains left over which is not worked by the cutter bodies 315*a* and 315*b*. By here besides the inner breaker surfaces 325*a*, additional breaker surfaces 325*b* of the wings 313*a* are provided.

Further with the fourth embodiment, the angular spacings measured about the boring head axis 321 between the wings 313*a* and 313*b* and thereby the angular spacings between the cutters 314*a* and 314*b* of the cutter bodies 315*a* and 315*b* are of different size. In this manner it is avoided that, if the impact frequency and the rotational speed of the drill are different from each other by a factor forming a paired number, the eccentrically arranged cutter bodies always hit at the same position on the boring ground, whereby the boring capacity would be impaired.

A further difference of the fourth embodiment with respect to the above resides in that here the cutters 314*a* and 314*b* which are arranged at different radial distances from the boring head axis 321 lie at different axial distances from the centering point 317, whereby the spacing of the radial inner cutters 314*b* from the centering point 317, as illustrated, can be smaller than that of the radial outer cutters 314*a*, or the reverse. Thereby the breaking open of the annular surfaces of the rock to be bored, which surfaces are unworked by the cutter bodies 315*a* and 315*b*, becomes easier.

Also with the fourth embodiment example, each surface 324 of the boring head body 312 which is between the wings 313*a* and 313*b* has at least one jacket line 319 which extends longitudinally to the boring head axis 321 and directly joins a jacket line 322 of the centering projection 316 and is inclined with respect to this at an obtuse angle.

I claim:

1. A drill for boring rock in a boring direction comprising a boring head body arranged on one end of a drill shank and having a central axis and at least two wings radially extending in different radial directions and having surfaces pointing in said boring direction, an axial centering projection having an end which projects in said boring direction in front of said wings, said wings and said centering projection constituting carriers of cutter bodies having cutting edges, said cutter bodies being arranged eccentrically on radial outer ends of said surfaces of said wings, and on the end of said centering projection, respectively, said centering cutter body on said centering projection projecting radially from said central axis and having a centering point on said central axis pointing in said boring direction, said eccentrically arranged cutter bodies having radial inner ends disposed from said centering cutter body at radial distances such that parts of said surfaces of said wings located radially between said inner ends and said centering cutter body form breaker surfaces serving during drilling to break annular surfaces, unworked by said cutter bodies, of rock to be bored, said boring head having channel type surfaces positioned between said wings, said centering projection having an outer surface defining centering projection jacket lines, each of said channel type surfaces having at least one bottom jacket line extending longitudinally to the longitudinal axis of said boring head body and directly joining one of said centering projection jacket lines, and said bottom jacket line forming at least at its joining end an obtuse angle with respect to said one centering projection jacket line.

2. The drill for rock, as set forth in claim 1, wherein said obtuse angle is at least 120°.

3. The drill for rock, as set forth in claim 1, wherein said breaker surfaces of said wings are convexly curved.

4. The drill for rock, as set forth in claim 1, wherein said eccentrically arranged cutter bodies are so located at different sides of said axis of said boring head that the angular distances between adjacent of said cutting edges are of different sizes.

5. The drill for rock, as set forth in claim 1, wherein the angles between said radial directions of adjacent of said wings are of different sizes.

6. The drill for rock, as set forth in claim 1, wherein each of said cutting edges of said eccentrically arranged cutter bodies is inclined with respect to a radial plane of said boring head body intersecting said cutting edge, by which borings during boring are fed radially outwardly.

7. The drill for rock, as set forth in claim 1, wherein said centering projection is formed from said one end of said drill shank, said boring head body is formed as an annular body securable on said drill shank, and said annular body forms said wings and therebetween said channel type surfaces each having at least said one bottom jacket line, the latter joining to at least said one centering projection jacket line of said outer surface of said centering projection.

8. The drill for rock, as set forth in claim 1, wherein said boring head body has more than two of said wings carrying said cutter bodies.

9. The drill for rock, as set forth in claim 8, wherein said boring head body has four of said wings.

10. The drill for rock, as set forth in claim 1, wherein said wings run helically about said axis of said boring head body.

11. The drill for rock, as set forth in claim 10, further comprising a helix formed on said drill shank for carrying away borings, and at least one helically shaped of said wings forms a forward end of said helix.

12. The drill for rock, as set forth in claim 10, wherein said drill shank is unround, a helical body formed complementary in part to said drill shank and having a helix thereon, and said helical body is pushably disposed complementarily on said drill shank with said helix extending to one of said wings of said boring head body.

13. The drill for rock, as set forth in claim 12, wherein said helical body is made of synthetic material.

14. The drill for rock, as herein-above set forth in claim 1, wherein said cutter bodies are eccentrically so arranged that at least some of said cutting edges are disposed at different radial distances from said axis of said boring head body.

15. The drill for rock, as set forth in claim 14, wherein a plurality of said cutting edges are arranged at one radial distance from said axis of said boring head body.

16. The drill for rock, as set forth in claim 14, wherein said cutting edges disposed at different radial distances from said axis of said boring head body are also disposed at different axial distances from said centering point.

17. The drill for rock, as set forth in claim 14, wherein at least one of said wings is formed with a different radial dimension as others of said wings.

18. The drill for rock, as set forth in claim 1, wherein said boring head body integrally forms said centering projection.

19. The drill for rock, as set forth in claim 18, wherein said boring head body is integrally formed on said drill shank.

20. The drill for rock, as set forth in claim 18, wherein said drill shank has a jutting out portion in a range of said wings.

* * * * *